US006656586B2

(12) United States Patent
Hartzog et al.

(10) Patent No.: US 6,656,586 B2
(45) Date of Patent: Dec. 2, 2003

(54) BICOMPONENT FIBERS WITH HIGH WICKING RATE

(75) Inventors: James V. Hartzog, Kinston, NC (US); James M. Howell, Greenville, NC (US); Michelle H. Watkins, Fisherville, VA (US); Claudia Schultze, Greenville, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/228,547

(22) Filed: Aug. 27, 2002

(65) Prior Publication Data

US 2003/0082377 A1 May 1, 2003

Related U.S. Application Data

(60) Provisional application No. 60/315,888, filed on Aug. 30, 2001.

(51) Int. Cl.[7] ..... D01F 8/00

(52) U.S. Cl. ..... 428/397; 428/399; 428/310; 428/373; 428/374

(58) Field of Search ..... 428/397, 399, 428/370, 373, 374

(56) References Cited

U.S. PATENT DOCUMENTS

| | | | |
|---|---|---|---|
| 3,536,763 | A | 10/1970 | Eleuterio et al. |
| 3,671,379 | A | 6/1972 | Evans et al. |
| 3,914,448 | A | 10/1975 | Gorrafa |
| 4,156,071 | A | 5/1979 | Knox |
| 4,634,625 | A | 1/1987 | Franklin |
| 5,626,961 | A | 5/1997 | Aneja |
| 5,736,243 | A | 4/1998 | Aneja |
| 5,817,740 | A | 10/1998 | Anderson et al. |
| 5,834,119 | A | 11/1998 | Roop |

FOREIGN PATENT DOCUMENTS

| | | | |
|---|---|---|---|
| JP | 96060442 | A | 3/1996 |
| JP | 2002-129433 | A | 5/2002 |
| WO | WO 97/02373 | A1 | 1/1997 |
| WO | WO 02/22926 | A1 | 3/2002 |

OTHER PUBLICATIONS

Patent Abstracts of Japan, Publication No. 2002129433, Publication Date May 9, 2002, Highly Strechable Polyester–Based Conjugated Fiber.

*Primary Examiner*—N. Edwards

(57) ABSTRACT

The invention provides a bicomponent fiber comprising poly(ethylene terephthalate) and poly(trimethylene terephthalate) and having:

a weight ratio of poly(ethylene terephthalate) to poly (trimethylene terephthalate) of at least about 30:70 and no more than about 70:30, a scalloped oval cross-section selected from the group consisting of side-by-side and eccentric sheath-core;

a cross-section long axis;

a boundary between the poly(ethylene terephthalate) and the poly(trimethylene terephthalate) that is substantially parallel to the cross-section long axis; and a plurality of longitudinal grooves.

10 Claims, 8 Drawing Sheets

BICOMPONENT FIBERS WITH HIGH WICKING RATE

CROSS-REFERENCE TO RELATED APPLICATION

This application claims benefit of priority from Provisional Application No. 60/315,888 filed Aug. 30, 2001.

BACKGROUND OF THE INVENTION

1. Field of the Invention

This invention relates to bicomponent fibers comprising poly(ethylene terephthalate) and poly(trimethylene terephthalate), particularly such fibers having a plurality of longitudinal grooves.

2. Description of Background Art

Polyester bicomponent fibers are disclosed in U.S. Pat. No. 3,671,379 and Published Japanese Patent Application JP08-060442, and non-round polyester fibers are disclosed in U.S. Pat. Nos. 3,914,488, 4,634,625, 5,626,961, 5,736,243, 5,834,119, and 5,817,740. However, such fibers can lack sufficient crimp levels and/or wicking rates, and fibers with improved wicking are still needed for dry comfort, especially in combination with the high stretch desired for today's apparel.

SUMMARY OF THE INVENTION

The present invention provides a bicomponent fiber comprising poly(ethylene terephthalate) in contact with poly (trimethylene terephthalate) wherein the weight ratio of poly(ethylene terephthalate) to poly(trimethylene terephthalate) is at least about 30:70 and no more than about 70:30 and wherein the bicomponent fiber has:

(a) a scalloped oval cross-section selected from the group consisting of side-by-side and eccentric sheath-core;

(b) a cross-section long axis;

(c) a boundary between the poly(ethylene terephthalate) and the poly(trimethylene terephthalate) that is substantially parallel to the long axis, and (d) a plurality of longitudinal grooves.

In another embodiment, the present invention provides a bicomponent fiber selected from the group consisting of fully-drawn continuous filament, fully-oriented continuous filament, partially oriented continuous filament, and fully-drawn staple wherein the fiber comprises poly(ethylene terephthalate) and poly(trimethylene terephthalate) and has:

a weight ratio of poly(ethylene terephthalate) to poly (trimethylene terephthalate) of at least about 30:70, a weight ratio of poly(ethylene terephthalate) to poly (trimethylene terephthalate) of no more than about 70:30, a scalloped oval cross-section selected from the group consisting of side-by-side and eccentric sheath-core, a cross-section long axis, a polymer boundary between the poly(ethylene terephthalate) and the poly(trimethylene terephthalate) and substantially parallel to the cross-section long axis, and a plurality of longitudinal grooves, wherein:

when the fiber is a fully-drawn filament, it has an after heat-set crimp contraction value of at least about 30%, when the fiber is a fully-oriented filament, it has an after heat-set crimp contraction value of at least about 20% when the fiber is a partially oriented bicomponent filament, it has an as-drawn after heat-set crimp contraction value of at least about 10%, and when the fiber is a fully-drawn staple, it has a tow crimp take-up value of at least about 10%.

DETAILED DESCRIPTION OF THE INVENTION

Figure 1:
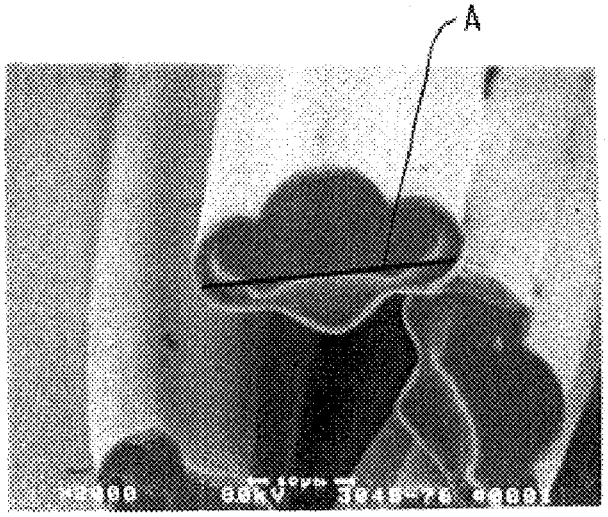
FIGS. 1 and 2 are cross-sections of bicomponent filaments of the invention.

As used herein, "bicomponent fiber" means a fiber in which two polyesters are in a side-by-side or eccentric sheath-core relationship and includes both crimped fibers and fibers with latent crimp that has not yet been realized.

"Cross-section aspect ratio" means the length of the cross-section long axis divided by the length of the maximum cross-section short axis.

"Groove ratio" means the average distance between the surfaces of the outermost bulges of a grooved fiber cross-section divided by the average distance between the grooves of the fiber cross-section.

"Fibers" includes within its meaning continuous filaments and staple fibers. The term "side-by-side" cross-section means that the two components of the bicomponent fiber are neither no more than a minor portion of either component is within a concave portion of the other component.

The fiber of the invention comprises poly(ethylene terephthalate) ("2G-T") and poly(trimethylene terephthalate) ("3G-T") and has a plurality of longitudinal grooves in the surface thereof. Such fibers can be considered to have a "scalloped oval" cross-section, for example, of the type shown in FIG. 3. It is preferred that the average bulge angle of the inner bulges, that is the average angle θ between two lines tangent to the cross-section surface and laid at the point of inflection of curvature (in fibers with flat-sided grooves, the "deepest" part of the groove) on each side of each of the inner bulges, be at least about 30° and that the two lines cross on the same side of the fiber as the bulge whose angle is being measured. Fibers of the invention having four such grooves can be termed 'tetrachannel', six grooves 'hexachannel', eight grooves 'octachannel', and so on. The weight ratio of poly(ethylene terephthalate) to poly(trimethylene terephthalate) in the bicomponent fiber is about 30:70 to 70:30, preferably 40:60 to 60:40.

When the fiber is spun as a partially oriented continuous filament, for example at spinning speeds of 1500 to 8000 m/min, and then drawn, for example at a draw ratio of 1.1× to less than 2×, specifically 1.6× for the purpose of testing, it has an as-drawn after heat-set crimp contraction value of at least about 10%. Especially when co-current flow quench gas is used, the draw ratio can exceed 4×, and the after heat-set crimp contraction value is at least about 30% even for fiber made at high spinning speeds. When the fiber is prepared as a fully-oriented (spin-oriented) continuous filament optionally without a separate drawing step, for example at spinning speeds in excess of about 4000 m/min and in the substantial absence of a co-current flow of quench gas, it has an after-heat-set crimp contraction value of at least about 20%. When the fiber is prepared as a fully-drawn continuous filament, for example at spinning speeds of about 500 to less than 1500 m/min, drawn, for example at a draw ratio of 2× to 4.5× and a temperature of about 50–185° C. (preferably about 100–200° C.), and heat-treated for example at about 140–185° C. (preferably about 160–175° C.), it has an after heat-set crimp contraction value of at least about 30%. When the fiber is a fully-drawn staple fiber, it has a tow crimp take-up value of at least about 10%.

It is preferred that the cross-section aspect ratio of the fiber be at least about 1.45:1 and no greater than about 3.00:1 and that the groove ratio be at least about 0.75:1, (more preferably at least about 1.15:1), and no greater than about 1.90:1. When the groove ratio is at least about 1.15:1, the cross-section aspect ratio can be at least about 1.10:1. When the groove ratio is too low, the fiber may provide insufficient wicking, and when it is too high, the fiber may be too easily split. It is also preferred that the fiber have at least four longitudinal grooves and more preferably have a tetrachannel cross-section.

The polymer boundary (between the poly(ethylene terephthalate) and the poly(trimethylene terephthalate) is substantially parallel to the cross-section long axis of the fiber. The polymer boundary is merely the line of contact between the polymers. As used herein, "substantially parallel to" includes within its meaning "coincident with" the cross-section long axis and does not preclude deviations from parallelism which may be especially evident adjacent to the surface of the fiber. Even when such deviations are evident, most of the poly(ethylene terephthalate) can be on the other side of the long axis from the poly(trimethylene terephthalate) and vice versa. When the polymer boundary is curved or somewhat irregular, as can sometimes be the case in a polyester bicomponent fiber, for example one with an eccentric sheath-core cross-section, substantial parallelism of the polymer boundary to the cross-section long axis can be assessed by comparing the predominant direction of the longest element of the boundary to the long axis. An example of such a predominant direction is line "A" in FIG. 1.

It is further preferred that the poly(ethylene terephthalate) have an intrinsic viscosity ("IV") of about 0.45–0.80 dl/g and the poly(trimethylene terephthalate) have an IV of about 0.85–1.50 dl/g. More preferably, the IV's can be about 0.45–0.60 dl/g and about 0.95–1.20 dl/g, respectively.

It is still further preferred that the initial wicking rate of the fiber of the invention be at least about 3.5 cm/min, as measured on a scoured single jersey circular knit fabric of about 190 g/m basis weight and comprising solely about 70 denier (78 decitex) fibers of 34 continuous filaments each.

One or both of the polyesters comprising the fiber of the invention can be copolyesters, and "poly(ethylene terephthalate)" and "poly(trimethylene terephthalate)" include such copolyesters within their meanings. For example, a copoly(ethylene terephthalate) can be used in which the comonomer used to make the copolyester is selected from the group consisting of linear, cyclic, and branched aliphatic dicarboxylic acids having 4–12 carbon atoms (for example butanedioic acid, pentanedioic acid, hexanedioic acid, dodecanedioic acid, and 1,4-cyclohexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 3–8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and araliphatic ether glycols having 4–10 carbon atoms (for example, hydroquinone bis(2-hydroxyethyl) ether, or a poly(ethyleneether) glycol having a molecular weight below about 460, including diethyleneether glycol). The comonomer can be present to the extent that it does not compromise the benefits of the invention, for example at levels of about 0.5–15 mole percent based on total polymer ingredients. Isophthalic acid, pentanedioic acid, hexanedioic acid, 1,3-propane diol, and 1,4-butanediol are preferred comonomers.

The copolyester(s) can also be made with minor amounts of other comonomers, provided such comonomers do not have an adverse affect on the wicking characteristics of the fiber. Such other comonomers include 5-sodium-sulfoisophthalate, the sodium salt of 3-(2-sulfoethyl) hexanedioic acid, and dialkyl esters thereof, which can be incorporated at about 0.2–4 mole percent based on total polyester. For improved acid dyeability, the (co)polyester(s) can also be mixed with polymeric secondary amine additives, for example poly(6,6'-imino-bishexamethylene terephthalamide) and copolyamides thereof with hexamethylenediamine, preferably phosphoric acid and phosphorous acid salts thereof.

The fibers of the present invention can also comprise conventional additives such as antistats, antioxidants, antimicrobials, flame-proofing agents, dyestuffs, light stabilizers, and delustrants such as titanium dioxide, provided they do not detract from the benefits of the invention.

Figure 2:
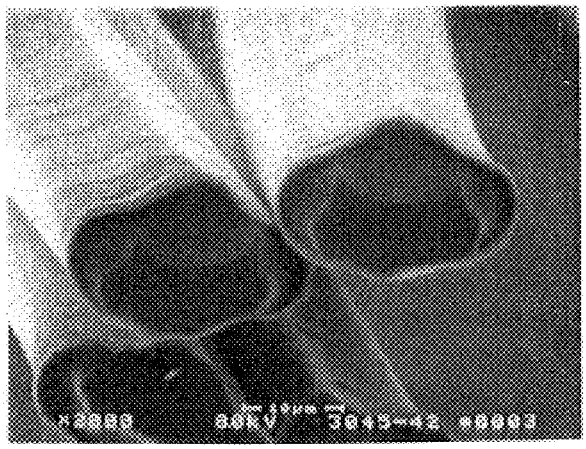

FIGS. 1 and 2 are photomicrographs of the fibers prepared according to Examples 3 and 1C, respectively. FIG. 3 shows idealized cross-sections of bicomponent tetrachannel fibers of the invention in which the two polyesters are indicated by differently hatched fill and the polymer boundary between them, by reference numeral 7.

Figure 3A:
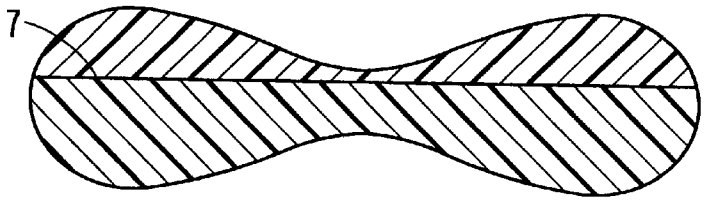
FIG. 3 shows idealized cross-sections of bicomponent fibers of the invention.
Figure 3B:
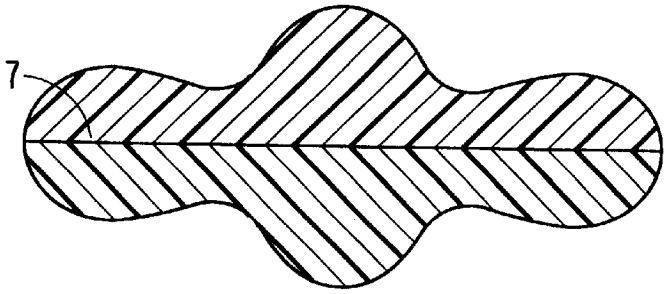
Figure 3C:
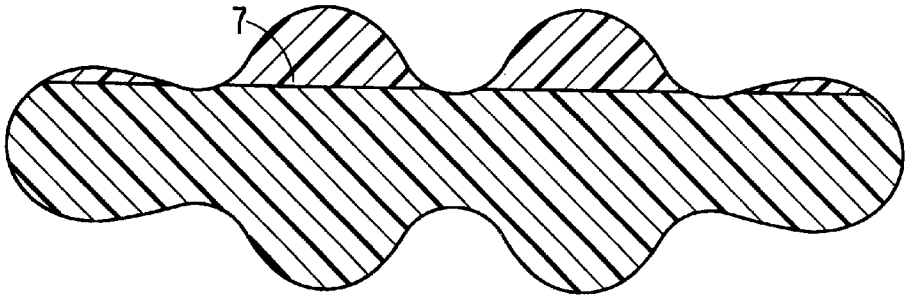

FIG. 3A shows a bichannel bicomponent fiber (sometimes called a 'dogbone' cross-section), FIG. 3B shows a tetrachannel bicomponent fiber with the polymer boundary substantially coincident with the cross-section long axis of the fiber, and FIG. 3C shows a hexachannel bicomponent fiber with the polymer boundary substantially parallel to the long axis of the fiber cross-section.

Figure 4A:
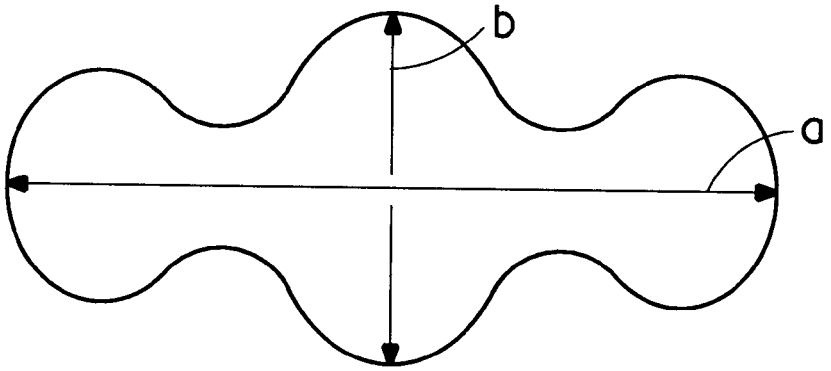
FIGS. 4A and 4B show cross-sectional dimensions of fibers of the invention.
Figure 4B:
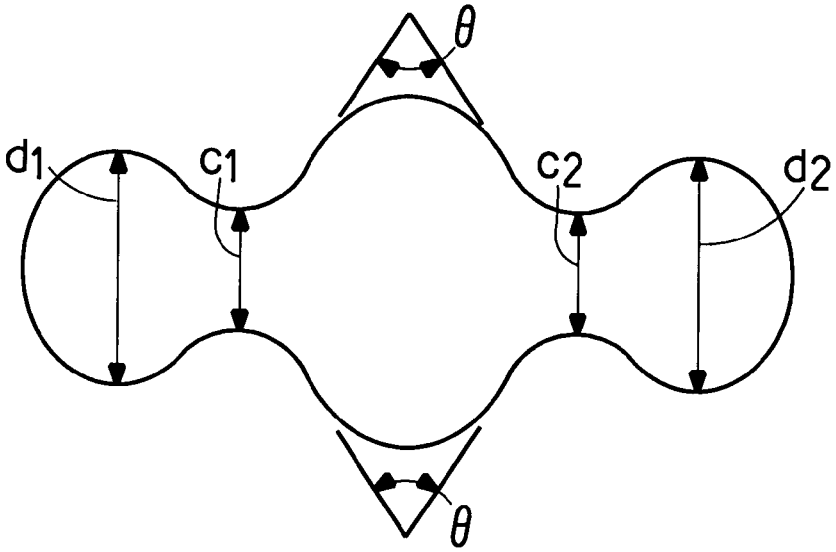

FIG. 4A shows a cross-section of a fiber of the invention in which 'a' indicates the length of the long axis of the cross-section and 'b' indicates the length of the short axis of the cross-section. FIG. 4B shows a cross-section of a fiber of the invention in which 'd1' and 'd2' indicate the distances between the outermost bulges of the fiber and 'c1' and 'c2' indicate the distances between the grooves of the fiber. FIG. 4B also shows angles θ, each formed by two lines tangent to the cross-section surface and laid at the point of inflection of curvature on each side of an inner bulge. Cross-section aspect ratios and groove ratios of the fibers in the Examples were measured from photomicrographs of the fiber cross-sections. Average ratios were calculated from at least five fibers. Referring to FIG. 4A, the aspect ratio of a tetrachannel fiber was calculated as a/b. Referring to FIG. 4B, the groove ratio of a tetrachannel fiber was calculated as $(d1/c1+d2/c2)/2$.

Figure 5A:
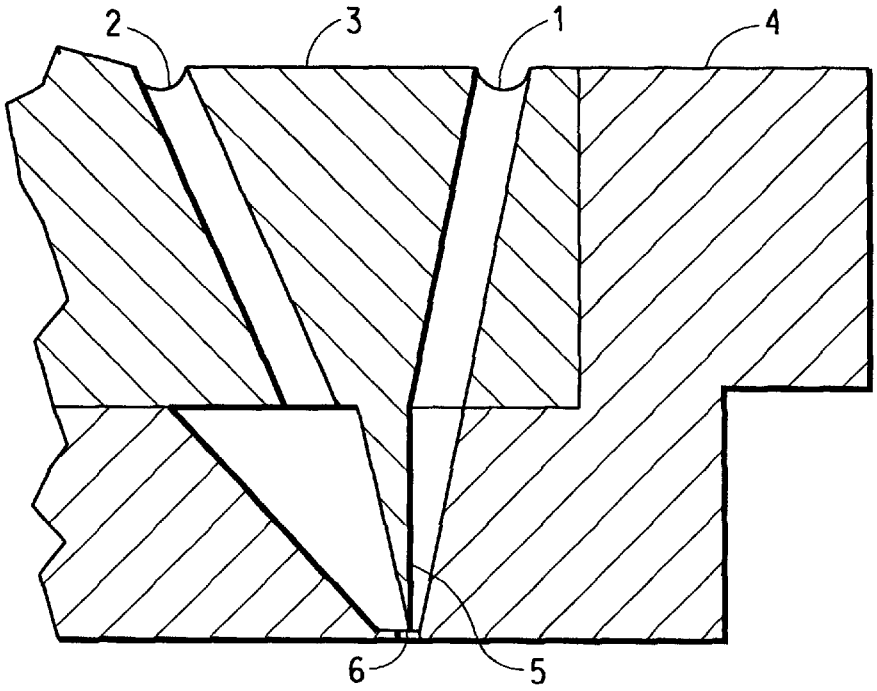
FIG. 5 illustrates a spinneret that can be used to make the fibers of the invention.
Figure 5B:
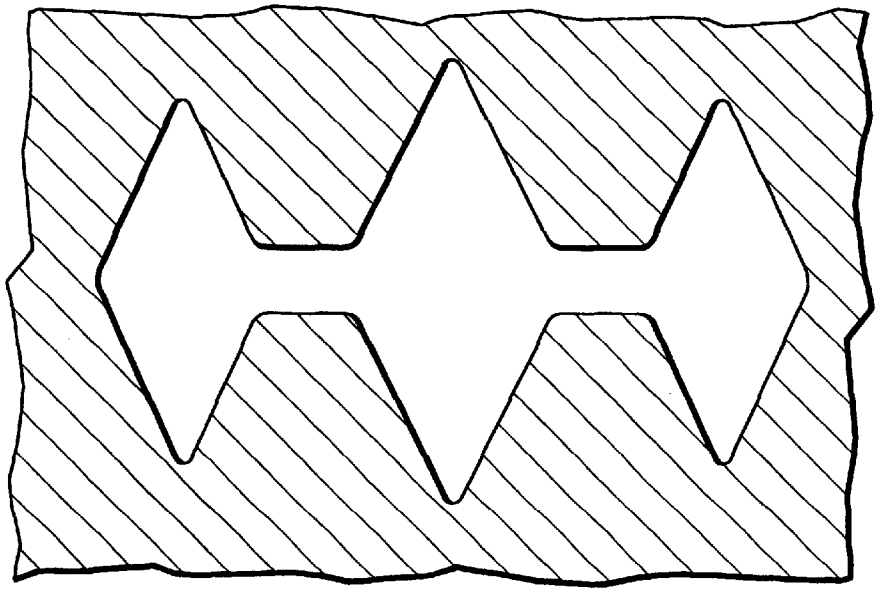

In the spinneret shown in FIG. 5A, the two polyesters can be fed separately to holes 1 and 2 in insert 3, which rests on support 4. Pairs of holes 1 and 2 can be arranged in concentric circles. The polyesters can be separated by knife-edge 5 until they reach the top of capillary 6, the shape of which is shown in FIG. 5B, and side-by-side bicomponent fibers can be spun from such a spinneret.

Figure 6:
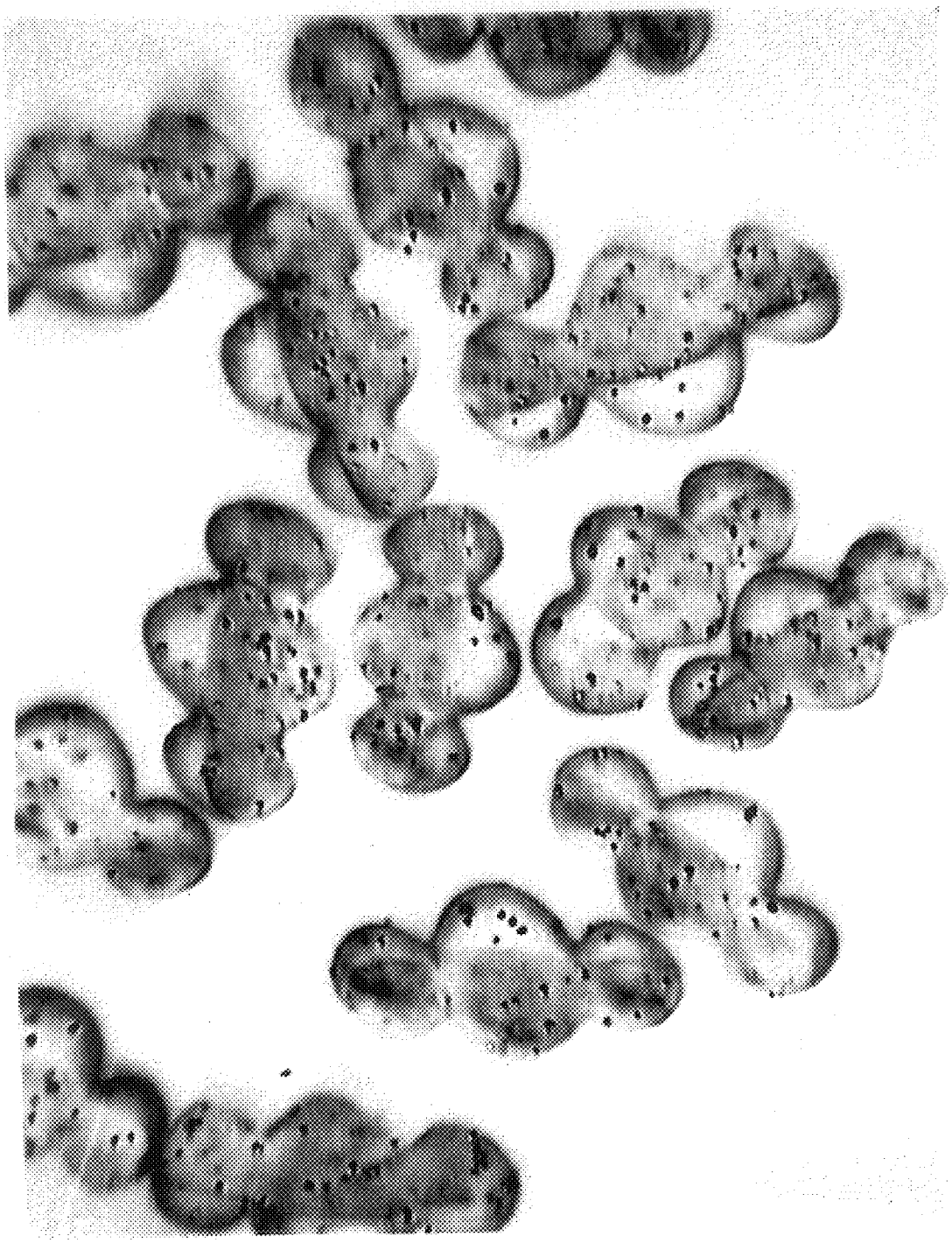
FIG. 6 is a micrograph of a cross-section of a bicomponent staple fiber of the invention.

FIG. 6 is a photomicrograph showing the cross-section of the staple fiber spun in Example 4.

Figure 7A:
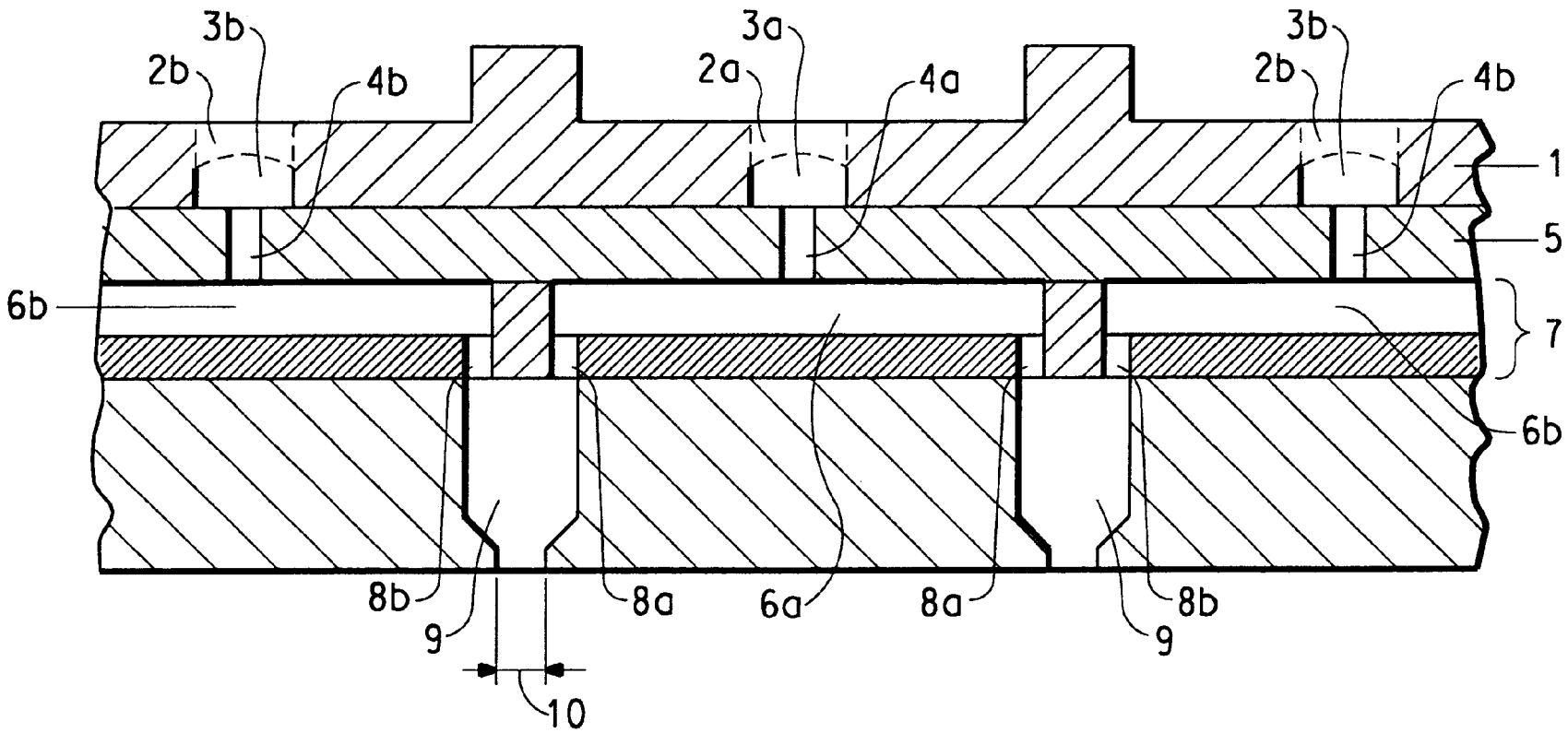
FIG. 7 shows a spin pack that can be used to make the fibers of the invention.
Figure 7B:
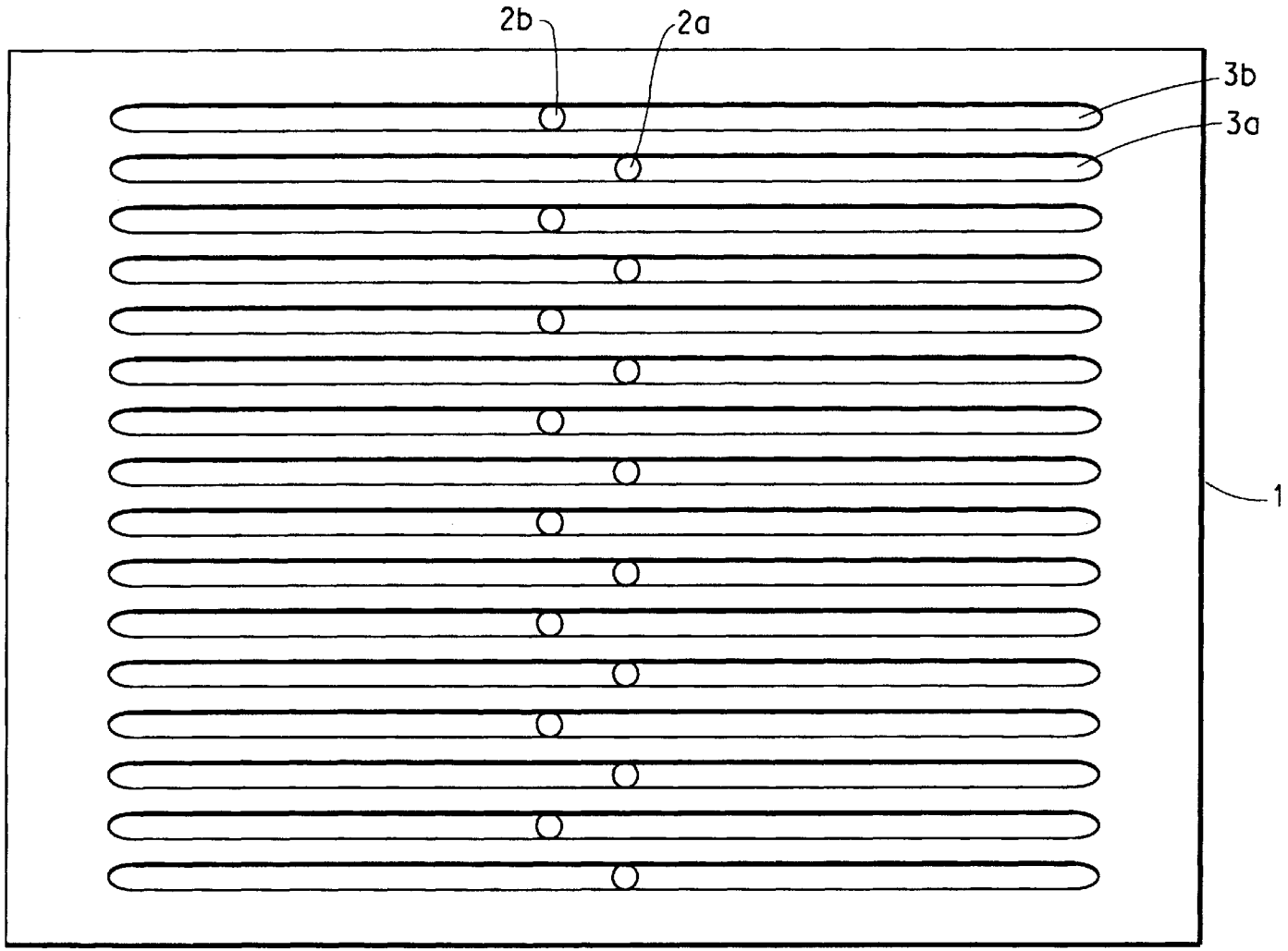
Figure 7C:
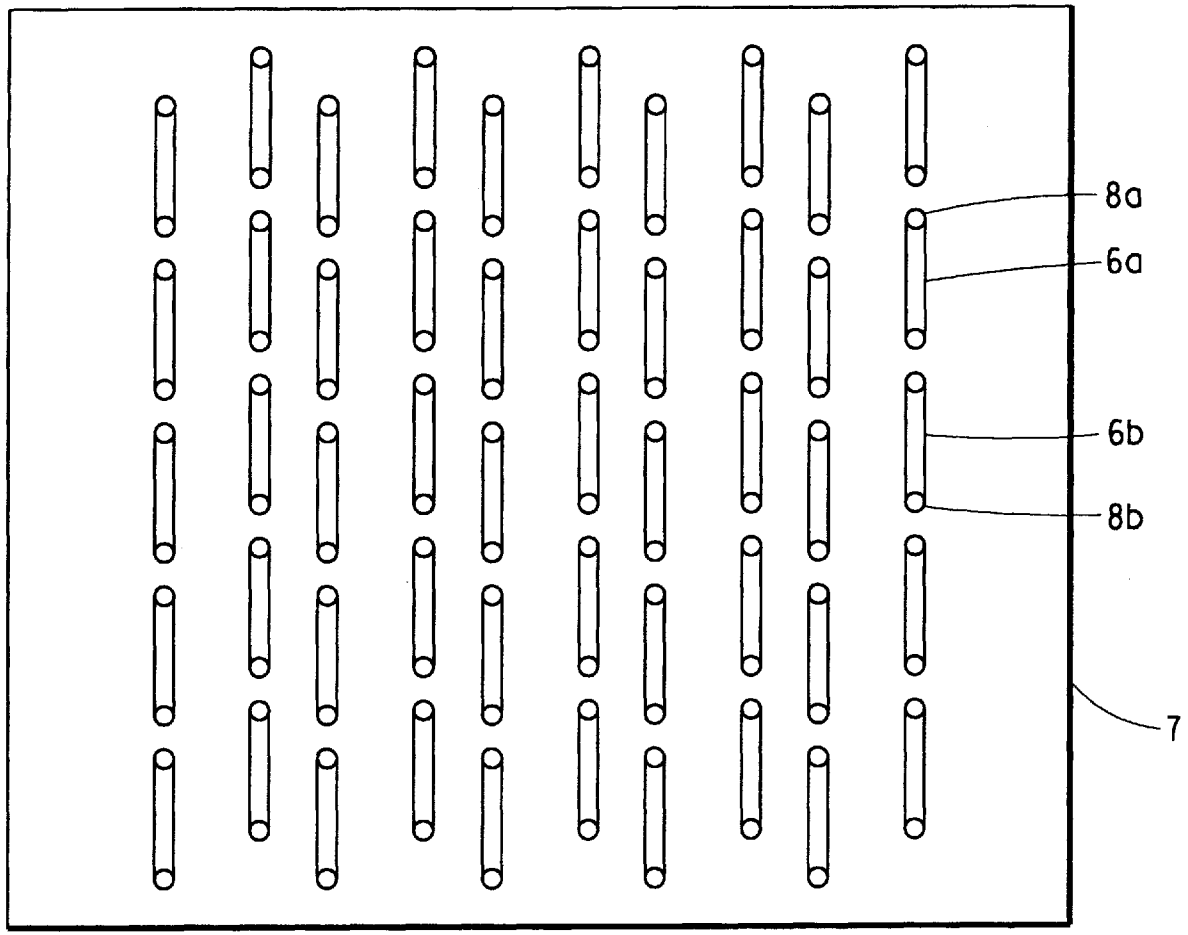

A spin pack useful in making fibers of the invention is illustrated in FIG. 7A, in which molten poly(ethylene terephthalate) and poly(trimethylene terephthalate) enter first distribution plate 1 at holes 2*a* and 2*b*, respectively, and pass through corresponding channels 3*a* and 3*b* to holes 4*a* and 4*b* in metering plate 5. On leaving metering plate 5, the polyesters enter grooves 6*a* and 6*b* of etched second distribution plate 7, exit through holes 8*a* and 8*b*, and meet each other as they enter spinneret counterbore 9. The short axis of the spinneret capillary is indicated as 10. FIG. 7B shows the downstream face of distribution plate 1, and FIG. 7C shows the upstream face of etched plate 6.

The as-drawn crimp contraction value of the bicomponent tetrachannel continuous filament prepared in Example 1C was measured as follows. Each sample, which had been drawn 1.6× under the conditions described in Example 1C, was formed into a skein of 5000+/−5 total denier (5550 dtex) with a skein reel at a tension of about 0.1 gpd (0.09 dN/tex). The skein was conditioned at 70+/−2° F. (21+/−1° C.) and 65+/−2% relative humidity for a minimum of 16 hours. The skein was hung substantially vertically from a stand, a 1.5 mg/den (1.35 mg/dtex) weight (e.g. 7.5 grams for a 5550 dtex skein) was hung on the bottom of the skein, the weighted skein was allowed to come to an equilibrium length for 15 seconds, and the length of the skein was measured to within 1 mm and recorded as "$C_b$". The 1.35 mg/dtex weight was left on the skein for the duration of the test. Next, a 500 gram weight (100 mg/d; 90 mg/dtex) was hung from the bottom of the skein, and the length of the skein was measured to within 1 mm and recorded as "$L_b$". Crimp contraction value (percent) (before heat-setting, as described below for this test), "$CC_b$", was calculated according to the formula $$CC_b=100\times(L_b-C_b)/L_b$$

The 500-g weight was removed and the skein was then hung on a rack and heat-set, with the 1.35 mg/dtex weight still in place, in an oven for 5 minutes at about 250° F. (121° C.), after which the rack and skein were removed from the oven and allowed to cool for at least 5 minutes. This step is designed to simulate commercial dry heat-setting, which is one way to develop the final crimp in the bicomponent fiber. The length of the skein was measured as above, and its length was recorded as "$C_a$". The 500-gram weight was again hung from the skein, and the skein length was measured as above and recorded as "$L_a$". The after heat-set crimp contraction value (%), "$CC_a$", was calculated according to the formula $$CC_a=100\times(L_a-C_a)/L_a.$$

The test was performed on five samples and the results were averaged. After heat-set crimp contraction values of fully-drawn bicomponent continuous filaments can be obtained by the same method, beginning with the skeining step.

The tow crimp take-up value of the grooved fiber prepared in Example 4 was determined as follows. A knotted loop was tied in each end of a sample of the tow. Tension was applied to the sample between the loops until it was taught, fixed metal clamps were secured to the sample near each end, and a pair of bobby pins was secured to the tow sample at a distance of 66 cm from each other and between the clamps. The sample was cut in two places 90 cm apart and between the clamps and the knotted loops while keeping the middle of the sample under tension. The sample was removed from the clamps and hung vertically, and its length was measured 30 seconds after tensioning and recorded in cm as the relaxed length, L. Crimp take-up ("CTU") was calculated from the formula $$CTU(\%)=[100\times(66-L)]/66.$$

For each reported value, at least two samples were tested, and an average was calculated.

The wicking rates of the fabrics in Example 2 were measured by vertically immersing the bottom 1.8 inches (4.6 cm) of a one inch (2.5 cm) wide strip of the scoured fabric in de-ionized water, visually determining the height of the water wicked up the fabric, and recording the height as a function of time. "Initial wicking rate" means the average wicking rate during the first two minutes of the wicking test.

The 'hand-stretch' of the fabrics in Example 2 was tested by pinching a measured 10 cm length and about 1 cm width of doubled fabric between the thumbs and forefingers, applying a uniform and reproducible stretching force on the fabric while holding it adjacent to a ruler, and recording the % stretch observed.

EXAMPLE 1

A. 1,3-Propanediol ("3G") was prepared by hydration of acrolein in the presence of an acidic cation exchange catalyst, as disclosed in U.S. Pat. No. 5,171,898, to form 3-hydroxypropionaldehyde. The catalyst and any unreacted acrolein were removed by known methods, and the 3-hydroxypropionaldehyde was then catalytically hydrogenated using a Raney Nickel catalyst (for example as disclosed in U.S. Pat. No. 3,536,763). The product 1,3-propanediol was recovered from the aqueous solution and purified by known methods.

B. Poly(trimethylene terephthalate) was prepared from the 1,3-propanediol described in Part A of this Example and dimethylterephthalate ("DMT") in a two-vessel process using tetraisopropyl titanate catalyst, Tyzor® TPT (a registered trademark of E.I. du Pont de Nemours and Company) at 60 ppm, based on polymer. Molten DMT was added to 3G and catalyst at 185° C. in a transesterification vessel, and the temperature was increased to 210° C. while methanol was removed. The resulting intermediate was transferred to a polycondensation vessel where the pressure was reduced to one millibar (10.2 kg/cm$^2$), and the temperature was increased to 255° C. When the desired melt viscosity was reached, the pressure was increased and the polymer was extruded, cooled, and cut into pellets. The pellets were further solid phase polymerized in a tumble dryer to an intrinsic viscosity of 1.3 dl/g.

C. Polyesters were spun to provide bicomponent tetrachannel filaments of the invention, shown in FIG. 2. Crystar® 4449 poly(ethylene terephthalate) (a registered trademark of E. I. du Pont de Nemours and Company) having an IV of 0.53 dl/g was melted and extruded at a maximum of 287° C., and the poly(trimethylene terephthalate) from Part B of this Example was melted and extruded at a maximum of 267° C. The two polymers were melt-spun at a 2G-T:3G-T 50:50 volume ratio (52:48 weight ratio) at a spin-block temperature of about 282° C. into a cross-flow air quench through the pre-coalescence 34-capillary spinneret illustrated in FIG. 5. The filaments were passed around a feed roll at 2560 to 2835 m/min and around a letdown roll at 2555–2824 m/min, and air-jet interlaced at 35 psi. An aqueous emulsion finish was applied at 0.5 wt % based on the weight of the fiber, which was then wound up at 2510 to 2811 m/min. The as-spun partially oriented fiber had a linear density of about 110 denier (122 decitex) and a tenacity of 1.8 dN/tex. The fiber was drawn 1.6× between two rolls over a plate heated to 160° C., the second roll operating at 400 m/min. The as-drawn linear density was 67 denier (74 dtex), and the fiber had 4.0 gpd (3.5 dN/tex) tenacity and an as-drawn after heat-set crimp contraction value ("CCa") of 16%. The average cross-section aspect ratio of the filaments was 1.53:1, the average bulge angle was about 125°, and the average groove ratio was 0.82:1.

COMPARISON EXAMPLE 1

Tetrachannel monocomponent poly(trimethylene terephthalate) comparison filament was prepared from poly (trimethylene terephthalate) prepared substantially as described in Example 1 Part B but having an IV of 1.02 dl/g. The highest temperature in the extruder was 250° C., the transfer line temperature was 254° C., and the spinneret block temperature was 260° C. The molten polymer was spun through a 34-hole spinneret having the cross-section shown in FIG. 5B and through a 1 inch (2.54 cm) long solid-walled tube positioned immediately below the spinneret face. The filaments then entered a radial quench system in which the quench gas was radially supplied from a foraminous distribution cylinder situated between the filaments and the quench gas supply plenum and having porosities that increased from a low value at a location immediately below the spinneret to higher values at intermediate locations and then decreased at locations toward the exit of the quenching chamber. Such a radial quench, without the 2.54 cm tube, is described in U.S. Pat. No. 4,156,071, which is incorporated herein by reference. The feed roll speed was 2050 yards/min (1875 m/min), the let-down roll speed was 2042 yards/min (1867 m/min), and the windup speed was 2042 yards/min (1867 m/min). A conventional finish was applied at 0.5 wt % based on fiber weight. The as-spun fiber had an average linear density of 106 denier (118 dtex) and was draw-textured 1.54× at 500 m/min and 180° C. on a false-twist texturing machine equipped with a polyurethane disc. The average as-drawn fiber linear density was 75 denier (83 dtex), the average cross-section aspect ratio was 1.79:1, and the average groove ratio was 1.35:1.

EXAMPLE 2

Single jersey fabrics were circular knit under the same conditions solely from the poly(trimethylene terephthalate) tetrachannel monocomponent filament spun in Comparison Example 1 (Comparison Sample 1), or solely from false-twist textured 34-filament Dacron® 938T poly(ethylene terephthalate) tetrachannel fiber (a registered trademark of E. I. du Pont de Nemours and Company; Comparison Sample 2), or solely from the bicomponent tetrachannel filament of Example 1 Part C (Sample 1, of the invention). All the yarns had 34 filaments and were knit as single ply.

Comparison Samples 1 and 2 were scoured for 30 minutes at 190° F. (88° C.) with 2.0 g/l (based on dyebath volume) Lubit® 64 (a dyebath lubricant from Bayer), 0.5 g/l Merpol® LFH (a low-foaming surfactant; a registered trademark of E. I. du Pont de Nemours and Company), and 0.5 g/l trisodium phosphate. The fabrics were then dyed in a fresh bath for 30 minutes (at 245° F. (118° C.) for Comparison Sample 1 or at 265° F. (129° C.) for Comparison Sample 2) at pH 5.3–5.5 (acetic acid) with 0.128 wt % (based on fabric weight) Intrasperse Violet 2RB (Yorkshire America) and 0.070 wt % Resolin Red FB (Dystar) in the presence of 1.0 g/l Lubit 64 and 1.0 wt % Merpol® LFH. The fabrics were post-scoured (to remove excess dye and lubricant) for 15–20 minutes at 180° F. (82° C.) with 0.5 g/l Merpol® LFH and 0.5 g/l trisodium phosphate, rinsed for 10 minutes at 120° F. (40° C.) with 0.5 g/l acetic acid, dried in a relaxed state at 200° F. (93° C.), and heat-set for 30 seconds at 325° F. (163° C.) (Comparison Sample 1) or at 350° F. (177° C.) (Comparison Sample 2).

Sample 1 was scoured 20 minutes at 160° F. with 0.5 g/l Merpol® LFH and 0.5 g/l trisodium phosphate, dyed for 45 minutes at 255° F. and pH 5.0–5.5 (acetic acid) with 8 wt % Resolin Black LEN (Dystar) in the presence of 1.0 wt % Merpol® LFH, post-scoured at 160° F. for 20 minutes with 4.0 g/l sodium dithionite (Polyclear NPH, Henkel Corp.) and 3.0 g/l soda ash, rinsed for 10 minutes at room temperature with 1.0 g/l acetic acid, dried, and heat-set for 30 seconds at 340° F. at constant width.

Samples of the yarns were removed from the finished fabrics, and their linear densities were determined to be 87 denier (Sample 1) and 82 denier (Comparison Samples 1 and 2). These are reported in Table 1.

The wicking rates and stretch properties of the fabrics were determined and are reported in Table I, in which "Comp." refers to a Comparison Sample.

TABLE I

| | Comp. Sample 1 | Comp. Sample 2 | Sample 1 |
|---|---|---|---|
| Basis Weight (g/m^2) | 185 | 163 | 188 |
| Thickness [cm] | 0.06 | 0.06 | 0.05 |
| Fiber decitex (in fabric) | 91 | 91 | 97 |
| Ply used | 1 | 1 | 1 |
| Fabric Density [g/cm^3] | 0.31 | 0.27 | 0.36 |
| Hand-stretch | | | |
| Course direction | 70% | 73% | 75% |
| Machine direction | 52% | 32% | 65% |
| Wicking rate (cm) | | | |
| Minutes: | | | |
| 0 | 0.0 | 0.0 | 0.0 |
| 2 | 6.1 | 5.3 | 8.9 |
| 4 | 6.9 | 6.1 | 9.9 |
| 6 | 7.9 | 6.9 | 12.2 |
| 8 | 8.6 | 7.9 | 12.4 |
| 10 | 9.1 | 8.6 | 12.7 |
| 12 | 9.4 | 9.7 | 12.7 |
| 14 | 9.7 | 10.2 | 12.7 |
| 16 | 10.2 | 10.9 | 12.7 |
| 18 | 10.4 | 11.4 | 12.7 |
| 20 | 10.7 | 11.9 | 12.7 |
| 22 | 10.9 | 12.4 | 12.7 |
| 24 | 11.2 | 12.7 | 12.7 |
| Initial wicking rate (cm/min) | 3.0 | 2.7 | 4.4 |

The data in Table 1 show that the fiber of the invention has a surprisingly rapid wicking rate and also higher stretch, which is particularly marked in the machine direction of the fabric.

EXAMPLE 3

Tetrachannel bicomponent filaments of the invention, as illustrated in FIG. 1, were spun from the same 3G-T at the same weight ratio and with the same spinneret as in Example 1 and FIG. 5, but with Crystar® 4415 poly(ethylene terephthalate) (0.54 dl/g IV) using the radial quench spinning system described in Comparison Example 1. The maximum temperature of the extruder for the poly(ethylene terephthalate) was 286° C., that for the poly(trimethylene terephthalate) was 266° C., and the spin block temperature was 278° C. The feed roll was operated at 2835 m/min, the letdown roll at 2824 m/min, and the windup at 2812 m/min. The partially oriented, as-spun fiber had a linear density of 111 denier (123 dtex), the average cross-section aspect ratio was 1.77:1, the average bulge angle was 82°, and the average groove ratio was 1.12:1.

EXAMPLE 4

Tetrachannel polyester side-by-side bicomponent staple fibers of the invention were prepared from Crystar® 3956 poly(ethylene terephthalate) having an IV of 0.67 dl/g and containing 0.3 wt % titanium dioxide and poly(trimethylene terephthalate) prepared substantially as in Example 1 Part B and having an IV of 1.04 dl/g. The highest extruder temperature was 290° C. for the 2G-T and 250° C. for the 3G-T, the 2G-T:3G-T volume ratio was 70:30 (71:29 weight ratio), and the melt temperature in the spin-block was 285° C. The spin pack was as shown in FIG. 7. The pre-coalescence spinneret had 144 capillaries of the same cross-section as shown in FIG. 5B. Filaments were spun at 800 m/min. Ends from 60 spinnerets were combined into a tow of about 22,500 denier (25,000 dtex), which was drawn 2.7× at 100 yards/min (91 m/min) in an 85° C. water bath, stuffer-box crimped with 15 psi (1.1 $Kg/m^2$) steam, and relaxed 1.4× at 100° C. for 8 minutes to give fully-drawn fibers with a final linear density of 2.6 denier (2.9 dtex) and a tow crimp take-up value of 12%. The tow was cut with a Lummus Reel staple cutter to 1.5 in (3.8 cm). The average cross-section aspect ratio was 1.85:1, and the average groove ratio was 1.58:1. A photomicrograph of the fiber cross-section is shown in FIG. 6.

What is claimed is:

1. A bicomponent fiber comprising poly(ethylene terephthalate) and poly(trimethylene terephthalate) and having:

a weight ratio of poly(ethylene terephthalate) to poly (trimethylene terephthalate) of at least about 30:70;

a weight ratio of poly(ethylene terephthalate) to poly (trimethylene terephthalate) of no more than about 70:30;

a scalloped oval cross-section selected from the group consisting of side-by-side and eccentric sheath-core;

a cross-section long axis;

a boundary between the poly(ethylene terephthalate) and the poly(trimethylene terephthalate) that is substantially parallel to the cross-section long axis; and a plurality of longitudinal grooves.

2. The fiber of claim 1 wherein:

when the fiber is a fully-drawn filament, it has an after heat-set crimp contraction value of at least about 30%;

when the fiber is a fully-oriented filament, it has an after heat-set crimp contraction value of at least about 20%;

when the fiber is a partially oriented bicomponent filament, it has an as-drawn after heat-set crimp contraction value of at least about 10%, and when the fiber is a fully-drawn staple, it has a tow crimp take-up value of at least about 10%.

3. The fiber of claim 1 having:

a cross-section aspect ratio of at least about 1.45:1;

a cross-section aspect ratio of no greater than about 3.00:1;

a groove ratio of at least about 0.75:1; and a groove ratio no greater than about 1.90:1.

4. The fiber of claim 1 having an initial wicking rate of at least about 3.5 cm/min.

5. The fiber of claim 1 wherein the fiber has a tetrachannel cross-section.

6. The fiber of claim 1 having:

a cross-section aspect ratio of at least about 1.10:1;

a cross-section aspect ratio of no greater than about 3.00:1;

a groove ratio of at least about 1.15:1; and a groove ratio no greater than about 1.90:1.

7. The fiber of claim 6 wherein the fiber is a fully-drawn continuous filament.

8. The fiber of claim 6 wherein the fiber is a fully-drawn staple fiber.

9. The fiber of claim 6 wherein the fiber is a partially oriented continuous filament.

10. The fiber of claim 6 wherein the fiber is a fully-oriented continuous filament.

* * * * *